United States Patent [19]

Tezuka et al.

[11] 4,270,448

[45] * Jun. 2, 1981

[54] PRINTING DEVICE

[75] Inventors: Chikao Tezuka; Hitoshi Mikoshiba, both of Shiojiri, Japan

[73] Assignees: Kabushiki Kaisha Suwa Seikosha; Shinshu Seiki Kabushiki Kaisha, both of Tokyo, Japan

[ * ] Notice: The portion of the term of this patent subsequent to Sep. 5, 1995, has been disclaimed.

[21] Appl. No.: 922,132

[22] Filed: Jul. 5, 1978

[30] Foreign Application Priority Data

Jul. 6, 1977 [JP] Japan ..... 52-80699

[51] Int. Cl.[3] ..... B41J 1/44

[52] U.S. Cl. ..... 101/99; 101/93.22

[58] Field of Search ..... 101/93.22, 93.29–93.34, 101/93.48, 95, 96, 99, 110

[56] References Cited

U.S. PATENT DOCUMENTS

| | | | |
|---|---|---|---|
| 3,169,474 | 2/1965 | Howard | 101/99 X |
| 3,477,365 | 11/1969 | Nyman | 101/93.48 X |
| 3,735,698 | 5/1973 | Lenders et al. | 101/93.22 X |
| 3,884,144 | 5/1975 | Shimodairn | 101/95 X |
| 3,929,067 | 12/1975 | Nishikawa et al. | 101/93.3 |
| 3,969,998 | 7/1976 | Venker | 101/93.48 X |
| 4,033,256 | 7/1977 | Hanaoka | 101/99 |
| 4,111,117 | 9/1978 | Tezuka et al. | 101/99 X |
| 4,152,982 | 5/1979 | Mikoshiba et al. | 101/93.22 |

*Primary Examiner*—Edward M. Coven

*Attorney, Agent, or Firm*—Blum, Kaplan, Friedman, Silberman & Beran

[57] ABSTRACT

In a printing device including rotatable character wheels having type characters on the surface thereof and a selection mechanism for selectively bringing a character to a printing position, a drive means is provided for moving the selection mechanism. Coupling between the drive means and the selection mechanism is effected by an electro-magnet, size and power requirements for the electro-magnet being reduced by the fact that the electro-magnet functions only as a coupling means and not as the drive means itself.

8 Claims, 6 Drawing Figures

FIG. 2
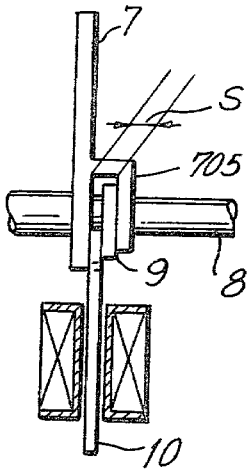
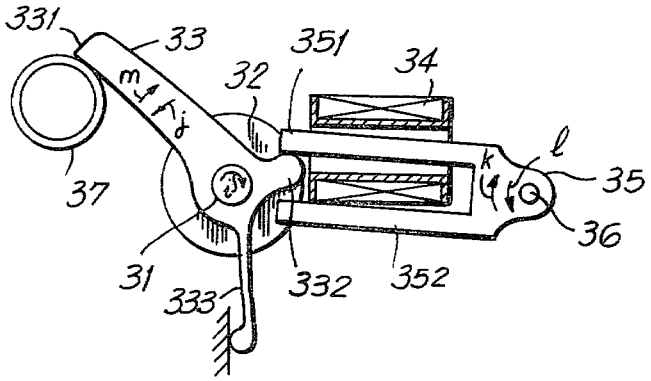
FIG. 3

PRINTING DEVICE

BACKGROUND OF THE INVENTION

In the design of compact printing devices, and, particularly, where the printing devices must operate at a relatively high speed, it has been the practice to provide a plurality of character rings on a rotatable shaft, each of the character rings having type characters on the periphery thereof. A selection mechanism provides for rotating each of the character rings into a position such that a selected character on each of the rings is in position for printing, at which time a printing hammer brings the inked character in contact with paper to effect the printing operation.

In an apparatus as described above, an electro-magnet conventionally is utilized to activate the selection mechanism, the activation following on the input of an electrical pulse to the electro-magnet. Where the electro-magnet itself moves the selection mechanism by way of a core in the electro-magnet, the electro-magnet must be relatively large and high-powered. These requirements are incompatible with the objectives of economy of size, weight and power consumption. Moreover, large-sized electro-magnets generate considerable noise and vibration during the operation thereof, these being substantial disadvantages. As is evident then, an improved means of driving the selection mechanism in a printing device is greatly to be desired.

SUMMARY OF THE INVENTION

In a printing device, a character ring, and, preferably, a plurality of character rings, is mounted on a rotatable shaft, there being sufficient clearance between the shaft and the rings so that the ring is not rigidly attached to the shaft. A claw member is spring-biased to engage selectively with a groove on the shaft for bringing the corresponding character ring into rotation with said shaft. A drive means is normally spaced apart from a selection means by a small gap, the selection means being spring-biased to hold the claw member disengaged from the shaft. An electro-magnet has an iron core so disposed in relation to the selection means and the drive means that the selection means and the drive means are brought together by the iron core when the electro-magnet is activated. Friction between the drive means and the selection means then activates the selection means when the drive means is in operation. Examples of preferred drive means are a rotating disc and an oscillating bar.

In a preferred arrangement the drive means, the selection means and an iron core disposed within the electro-magnet constitute a magnetic circuit in which there is a small gap between the drive means and the selection means. Activation of the electro-magnet couples the drive means to the selection means by closing the gap therebetween.

The advantage of using an electro-magnet in the coupling of a drive means to a selection means is that the magnet may be small and of low power whereas where the magnet acts as the principal drive for the selection means, the electro-magnet must be relatively large and heavy.

In general, the selection means is spring-biased toward a rest or stand-by position so that the drive means is used only for displacing the selection means to an actuation position, return of the selection means to stand-by position being accomplished by biasing means.

In addition to said rotating disc and said oscillating bar as drive means, a selection shaft which is rotatable and with which said selection means may be coupled may also serve as a drive means.

Accordingly, an object of the present invention is a printing device in which selection of a type character on a character wheel is effected by means of an electro-magnet of smaller weight and lower power than has previously been the case.

Another object of the present invention is a printing device in which an electro-magnet serves for coupling a drive means to a selection means, the principal mode of power for operating the selection means being provided by the drive means, the electro-magnet serving only for joining the drive means to the selection means.

A further object of the present invention is a printing device in which selective rotation of a character ring is effected through the use of a claw member which joins with a groove on a rotating shaft for bringing the character wheel into rotation.

An important object of the present invention is a selection means having an integral spring for biasing same toward a stand-by position.

A significant object of the present invention is a printing device in which a plurality of selection means can be manufactured as an integral unit.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 2 is an embodiment of the present invention in which the drive means is a rotating disc;

FIG. 3 is another embodiment of the present invention in which a selection means is biased with an integral spring;

DETAILED DESCRIPTION OF THE PREFERRED EMBODIMENTS

Figure 1:
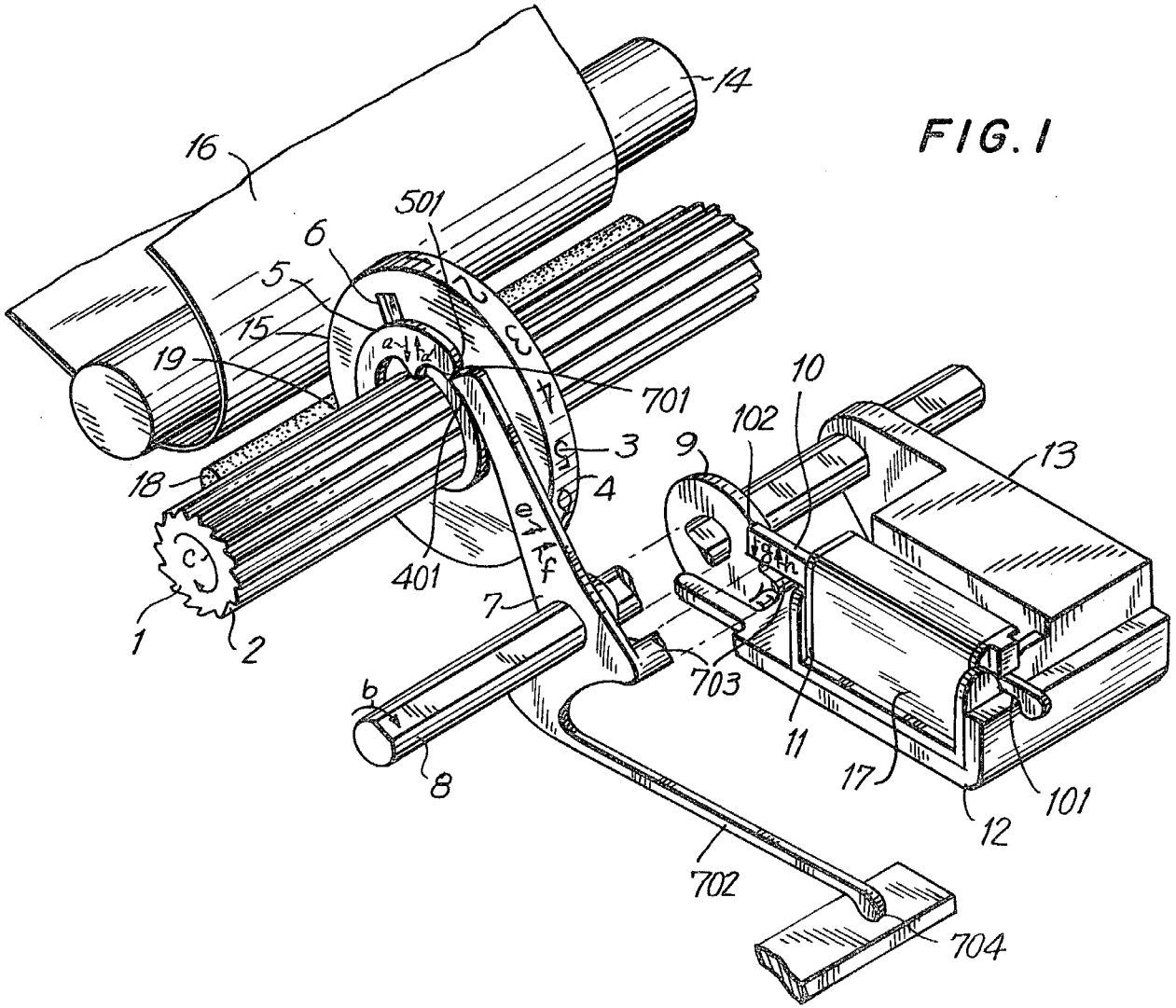
FIG. 1 is an oblique view in perspective of an embodiment of the present invention.

Referring to FIG. 1, a rotatable shaft 1 supports character rings 4 (only one being shown), each character ring having type characters 3 on the periphery thereof. A friction spring 5 is fitted to the side face of character ring 4, said spring being biased to exert a force in the direction of the arrow a so as to bring the spring into engagement with a selected groove 2 on shaft 1. Also, friction spring 5 is slideably engaged with channel 6 on the side face of character ring 4.

A selecting claw 7 controls engaging and disengaging of friction spring 5 with groove 2 of rotatable shaft 1 by rotation of said selecting claw 7 in the directions indicated by the arrows e and f. Selecting claw 7 is mounted for rotation on shaft 8 to which is firmly affixed disc 9 of a magnetic substance, preferably iron, shaft 8 rotating in the direction indicated by the arrow b.

Coil frame 11 has therein a coil having an open central portion into which is inserted an iron core 10 which is free to slide in the directions indicated by the arrows g and h, iron core 10 having a notched portion 101 which engages with the end face of L-shaped yoke 12. Head portion 102 of iron core 10 is normally positioned proximate one of the side faces of disc 9. Trigger case 13 holds coil frame 11 and has a bearing part for rotatably supporting selecting claw shaft 8.

The printing device of the present invention includes a printing hammer 14 positioned opposite printing position 15 of the character 3 which faces printing paper 16.

In the selection of a character, shaft 1 rotates in the direction of the arrow c, shaft 1 and selecting claw shaft 8 being coupled by gearing or other known means so that they rotate simultaneously, shaft 8 rotating in the direction indicated by the curved arrow b. Disc 9 being integral with claw shaft 8, rotates therewith. The friction spring 5 is made to rotate the character ring 4 in the same direction as the shaft 1 when it engages groove 2 and engages channel 6 on the side face of character ring 4. However, when the selecting claw 7 is in the stand-by state, said selecting claw rotates in the direction of the arrow e as the result of the biasing force of spring portion 702 which is integral with said selecting claw. Selecting claw 7 then comes to rest upon stop 401 of character ring 4 and the head portion 501 of friction spring 5 which is rotating integrally with shaft 1 is brought to a stop by the inclined surface of head portion 701. Friction spring 5 is lifted away from shaft 1 in the direction indicated by the arrow d, thereby releasing the engagement of friction spring 5 with groove 2 of the shaft and also releasing engagement of friction spring 5 with character ring 4 so that shaft 1 then runs idle with respect to character ring 4.

During the stand-by state of the selecting claw, or when no character 3 on character ring 4 is to be selected, friction spring 5 repeats the sequence of engaging with and detaching from groove 2 on rotatable shaft 1 as shaft 1 rotates in the direction indicated by the arrow c. When the specific groove 2 corresponding to a selected character 3 which is to be employed for printing comes to a position facing friction spring 5, coil 17 is activated and selecting claw 7 is rotated in the direction indicated by the arrow f against the force of the spring portion 702 by operation of the magnetic means in a sequence which will be described later, and selecting claw 7 is moved out of contact with head portion 501 of friction spring 5.

In this condition, spring 5 which is engaged with groove 2 of shaft 1 then causes rotation of character ring 4 to bring the selecting character 3 to printing position 5. This operation is carried out for all of the character rings on shaft 1, and after all of the selected characters 3 to be printed have been aligned at the printing position 15, printing hammer 14 effects movement of the printing paper 16 placed between printing hammer 14 and character ring 4. This step completes the printing operation.

The way in which electro-magnet 17 rotates selecting claw 7 is as follows: Electro-magnet 17 is actuated by means of an electric pulse, establishing a magnetic circuit consisting of iron core 10, yoke 12 and disc 9. Iron core 10 and disc 9 normally have a small gap therebetween but when the electro-magnet is actuated, iron core 10 is drawn toward disc 9, closing the gap so that a face of head portion 102 of iron core 10 makes frictional contact with a side face of disc 9. Iron core 10 is then subject to a force exerted thereon by disc 9 which is being rotated in the direction indicated by the arrow b, this force depressing iron core 10 in the direction of arrow g. Portion 102 of iron core 10 then depresses finger 703 which is integral with selecting claw 7, thereby rotating said selecting claw 7 in the direction indicated by the arrow f. Current to electro-magnet 17 is terminated after friction spring 5 completes rotation to a desired position with shaft 1. The attracting force between disc 9 and head portion 102 of iron core 10 is thereby eliminated and engagement therebetween is released. Selecting claw 7 then rotates in the direction indicated by the arrow e as the result of biasing force exerted by spring portion 702 and selecting claw 7 is restored to stand-by position. Simultaneously, iron core 10 is also pushed upwardly in the direction indicated by arrow h by finger 703 on selecting claw 7, restoring iron core 10 to stand-by position. It should be noted that selecting claw 7 and disc 9 in FIG. 1 are actually close together but are separated in FIG. 1 for purposes of clarity.

After completion of a printing step, shaft 1 is further rotated in the c direction, friction spring 5 and character ring 4 rotating together as a unit. When head portion 501 of friction spring 5 makes contact with head portion 701 of selecting claw 7 which has been returned to stand-by position as the result of termination of the current pulse to electro-magnet 17, friction spring 5 is pushed upwardly in the d direction, thereby disconnecting friction spring 5 from engagement with groove 2 of shaft 1. Character ring 4 then comes to a stop and shaft 1 runs idle. This step constitutes completion of a printing cycle.

The construction of the printing device of the present invention is such that a first space between the side of disc 9 and the side of head portion 102 of iron core 10 and a second space between the side of disc 9 and the side of a comb-like notch or the tip of yoke 12 are both very small. Consequently, the loss in magnetic force as a result of these gaps is small, thereby insuring a large attracting force for a very small consumption of power. The tip of yoke 12 referred to herein may be located at the periphery of disc 9 with a very small space therebetween, the construction in this case not being comb-like. Such a construction makes it possible for the cost of yoke 12 to be lowered.

In conventional constructions, a large stroke to effect the movement of the selection claw is necessary as the result of which a large gap must be present in the magnetic circuit. Such a large gap causes a large magnetic loss and a substantial lowering of the efficiency of the system. If an attempt is made to decrease the distance through which attraction must be effected, a lever or other mechanism must be introduced so as to provide a large stroke in working the selection claw. Such mechanisms introduce serious losses by reason of friction so that, once more, such systems are very inefficient. In contrast, according to the present invention, the construction is such that the distance through which attraction must be effected is very small and is completely unrelated to the necessary stroke or angles through which the selecting claw must move. The present invention and the device in accordance with the invention provides for high efficiency in the magnetic circuit due to the fact that the electro-magnet serves only to couple the drive means, whatever it may be, to the selection claw. Because the efficiency of a motor may be as much as 10 to 20 times as great as that of an electro-magnet, a stroke of any size may be obtained by means of a motor which, of course, is used for activating the drive means. Moreover, due to the inertial force of the rotor of the motor, it is possible to reduce the average power which must be supplied to the drive means. The overall result of the structure of the mechanism taught herein is that the necessary work can be carried out with a much lower consumption of power than has hitherto been the case. Moreover, since the consumption of power by the electro-magnet is decreased, coils, iron cores, etc., may be decreased in size so that there is effected a reduction in the cost of parts, the cost of assembly and in the size of the unit.

As aforenoted, a face of head portion 102 of iron core 10 is located closely proximate to a face of disc 9, the construction of iron core 10 being such that it can slide toward and away from the face of disc 9, it being desirable to provide guides so as to control the size of the gap therebetween and the motion of iron core 10 towards disc 9. An embodiment of the invention is shown in FIG. 2 in which an L-shaped guide part 705 is provided integrally on selecting claw 7, said guide 705 defining a space S within which disc 9 and iron core 10 are confined. By constraining iron core 10 and disc 9 to lie within the space S of guide part 705, the gap between disc 9 and iron core 10 can be closely defined.

A major difference between the printing device of the present invention and conventional printing devices stems from the fact that the character rings in the conventional devices rotate integrally with the shaft until such time as a character is to be selected, the character rings being brought to a stop when a character to be printed arrives at a printing position, printing then being effected. However, in the printing device of the present invention, the character ring 4, when the process of selection is not being effected, remains in a stand-by position which is exactly contrary to the way in which conventional devices function. The character ring 4 of the present invention starts rotating and rotates to the printing position 15 only when selected. One benefit which accrues therefrom is that ink transfer can simultaneously be made during one turn of the shaft 1 in a selecting stroke, ink roller 18 being located in transfer position 19. Furthermore, ink roller 18 and character 3 come in contact with each other by rolling. In the conventional system, on the other hand, there are both oscillating contact and rolling contact between the ink roller and the character ring, thereby introducing a serious problem with respect to rapid wear of the ink roller, this being accentuated by the fact that the character rings rotate continually except during the printing process. This difficulty is eliminated in the printing device of the present invention since the character rings rotate only during the selection process. Moreover, the structure of the printing device is such that an inked ribbon may be used instead of an ink roller.

Figure 4:
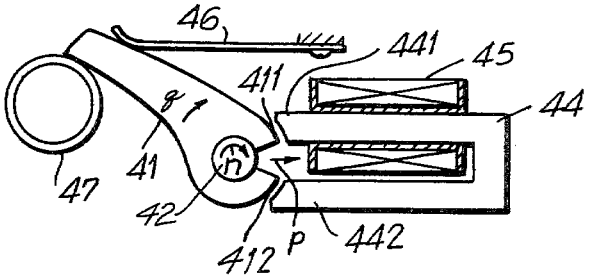
FIG. 4 is an embodiment in which a drive means is a rotating shaft.
Figure 5:
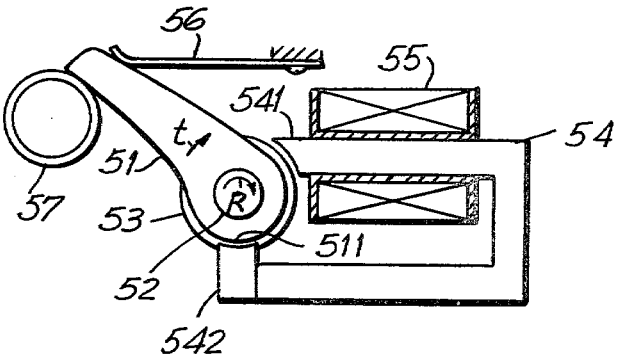
FIG. 5 is another embodiment of the present invention in which a drive means is a rotating disc.

Spring portion 702 which energizes selecting claw 7 in the e direction may be a separate and independent spring portion as shown in FIGS. 4 and 5, but it is preferable that it be integral with said selecting claw that is shown in FIG. 3. A major advantage is a reduction in cost. In addition, since a separate selecting claw 7 is to be provided for each character ring, a number of claws can be integrally formed for using a single support point 704. Also, it is possible to manufacture the coupling section of a plurality of units together and to cut these apart after assembly. A further advantage in the construction of FIG. 1, is that the bearing portion of selecting claw shaft 8 on trigger case 13 makes it possible to assure the accuracy of the relative positions among selecting claw 7, disc 9, iron core 10 and coil frame 11 so that relatively rough components of low cost and inexpensive construction may be employed. In addition, subassembly is simplified, leading to a reduction in the number of steps involved in the assembly process.

Further embodiments of the invention are shown in FIGS. 3 through 6. In the embodiment of FIG. 3, selecting claw shaft 31 has firmly attached thereto disc 32 of a magnetic substance, preferably iron, and rotatably supports selecting claw 33, shaft 31 rotating in the direction indicated by arrow i. A U-shaped yoke 35 has a leg 351 which is slidably inserted in the central portion of coil 34. Leg 351 is an iron core so disposed that said leg, together with second leg 352 of said iron core may slide to make contact with the face of disc 32, said legs 351 and 352, normally being separated from disc 32 by a small gap therebetween. Yoke 35 is supported on shaft 36 about which it may turn freely.

In the stand-by state, selecting claw 33 is rotated in the direction of the arrow j by the biasing force of spring part 333 which is integral with selecting claw 33 and which urges said selecting claw against support 37. Projection 332 on selecting claw 33 rotates yoke 35 in the direction of the arrow k rotation of yoke 35 in this direction being terminated when leg 351 of said yoke engages projection 332.

When coil 34 is excited, legs 351 and 352 of yoke 35 are attracted to the face of disc 32. Since disc 32 rotates in the arrow i direction, yoke 35 is moved by frictional contact with disc 32 so that it rotates in the direction of the arrow l, support 36 being the center for rotation. In the course of this rotation, projection 332 engages with leg 351 of yoke 35 and rotates selecting claw 33 in the direction of the arrow m. When the current flow through coil 34 is terminated, yoke 35 and disc 32 cease to attract each other and biasing force of spring part 333 moves selecting claw 33 to contact with support 37 and rotates yoke 35 in the arrow k direction by means of contact with projection 332. The selection mechanism is thereby returned to stand-by position. As will be evident, head portion 331 of selecting claw 33 is equivalent to head part 701 of selecting claw 7 of FIG. 1 and coil 34 and yoke 35 are equivalent to the electro-magnet 17 of FIG. 1. The advantage of the yoke of FIG. 3 over the mechanism of FIG. 1 is that clearance may develop between the engaging section of notch 101 at the tail of iron core 10 and the face of the yoke 12, but since yoke 35 of FIG. 3 is in one solid piece, no clearance or gap in the magnetic circuit can appear at this point so that the magnetic loss is lower and the efficiency is higher. A further point is that where the yoke 12 of FIG. 1 is of comb-like form and is brought into contact with disc 9, the attracting surface causes a frictional loss against disc 9 because the yoke 12 is fixed thereto. However, in the embodiment of FIG. 3, the two legs 351 and 352 of yoke 35 can move with the rotation of disc 32 which is satisfactory from the standpoint of decreasing the magnetic loss. It follows, therefore, that although the embodiment of FIG. 1 has a higher magnetic efficiency than that of conventional devices, the embodiment of FIG. 3 is superior to that of FIG. 1 in this respect.

In the embodiment of FIG. 4, a selecting claw is made of a magnetic substance such as iron, said selecting claw being rotatably supported by selecting claw shaft 42 which rotates in the direction of the arrow n. Yoke 44 has the shape of a U, the two legs of said yoke being proximate tail parts 411 and 412 of selecting claw 41 with a very small gap between said legs of said yoke and said tail parts 411 and 412 of said selecting claw 41. Electro-magnet coil 45 surrounds leg 441 of yoke 44. In stand-by position, selecting claw 41 rests against stop 47 under the urging of spring 46. When coil 45 is actuated, tail parts 411 and 412 are attracted toward legs 441 and 442 respectively of yoke 44 in the direction of the arrow p. Frictional force is thereby generated between selecting claw 41 and selecting claw shaft 42 so that said selecting claw 41 rotates in the direction of the arrow q, selecting claw shaft 42 rotating in the direction of arrow n. This rotational movement of selecting claw 41 is the equivalent of that of selecting claw 7 in FIG. 1, the remainder of the mechanism being of the same general construction, so that the magnetic means, as shown in FIG. 4, may be employed on character rings and character ring selecting mechanisms as shown in FIG. 1. It should be noted that selecting claw shaft 42 may be either of a magnetic substance or of a non-magnetic substance. The construction of the actuation device of FIG. 4 requires a reduced number of parts which can readily be assembled at low cost so that the entire construction is low in cost. Moreover, coil 45 and yoke 44 are integral and there is no relative movement of coil 45 with respect to yoke 44 so that precision of assembly is not required, this feature further reducing the cost of the system.

In the embodiment of FIG. 5, selecting claw 51 is of a magnetic substance, preferably iron, which is rotatably supported by selecting claw shaft 52 which rotates in the direction of arrow r. Disc 53 is firmly affixed to selecting claw shaft 52 and rotates therewith. Disc 53 is separated from selecting claw 51 by a very small gap. Yoke 54 is in the shape of an incomplete rectangle, having a leg 541 which faces the periphery of disc 53 across a very small gap. Another leg 542 of yoke 54 also is disposed across a very small gap from the periphery of selecting claw 51. Also, electro-magnet coil 55 is positioned around one leg 541 of yoke 54. In stand-by position, selecting claw 51 is pressed against stop 57 by selecting claw spring 56. When coil 55 is actuated, an attracting source is generated between a side face of selecting claw 51 and the proximate side of disc 53 bringing them into frictional contact. Disc 53 then drives selecting claw 51 in the direction indicated by the arrow t, selecting claw 51 rotating with disc 53 on shaft 52. The selecting claw 51 then operates a friction spring 5 and a character ring as shown in FIG. 1.

The magnetic device of FIG. 5 is low in cost and simple to assemble; the transmission of force between the disc and the selecting claw is effective and the magnetic circuit has a low relucatance. Accordingly, reliability is great, the rate of wear is low and power consumption is low.

Figure 6:
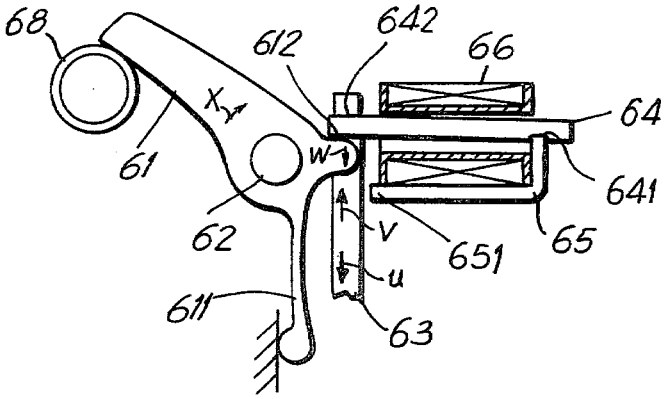
FIG. 6 is yet another embodiment of the present invention in which a drive means is an oscillating bar.

A further embodiment of the invention is shown in FIG. 6 in which selecting claw 61 is rotatably supported by selecting claw shaft 62, said selecting claw 61, in stand-by condition, resting against stop 68 as a result of the biasing force of spring part 611 which is integral with said selecting claw 61. Oscillatory plate or bar 63 moves reversably in the directions of the arrows u and v. Iron core 64 lies within the center of coil 66, the tail portion 641 of said iron core engaging with the end face of yoke 65, and the head portion 642 of said iron core 64 being disposed proximate a side face of oscillating plate 63 with a very small gap therebetween. Head portion 651 of yoke 65 faces oscillating plate 63 with a very small gap therebetween so that the magnetic circuit consisting of yoke 65, iron core 64 and oscillating plate 63 have only small gaps therein. If the coil is excited when the oscillating plate 63 is moving in the direction of arrow u, iron core 64 and oscillating plate 63 make frictional contact, and iron core 64 moves with oscillating plate 63 in the u direction. Head part 642 of iron core 64 makes contact with projection 612 on claw 61, moving said projection 612 in the direction indicated by the arrow w, this movement rotating claw 61 in the direction indicated by the arrow x. Movement of plate 63 in the direction v eliminates the force exerted against projection 612 and allows spring member 611 to return claw 61 to contact with support 68.

As is evident from FIGS. 4, 5 and 6, the drive means used for rotating a claw can be a rotating shaft on which the claw is mounted, a disc or an oscillating plate or bar. The magnetic means of the present invention can effect selection of a character on a character ring for printing utilizing any of these types of drive means, the particular type of drive means used being chosen in accordance with the particular application.

A number of examples have been given above with respect to a character ring selecting mechanism based upon an electro-magnet which controls a selecting mechanism, the electro-magnet of the present invention having a much greater overall efficiency and lower power consumption than conventional electro-magnets used for the same purpose in conventional devices. The reasons, as explained above, for the advantage of the electro-magnet as taught herein, is that only a small stroke is required for effecting a transfer of a relatively large amount of energy so that the distance through which the electro-magnet must act can be made very small. The entire arrangement provides for miniaturization both in size and weight and for decrease in cost.

In accordance with the present invention the character ring selecting mechanism has a particular advantage in that where an ink roller is employed, no particular process for ink application need be provided and ink is applied to the character during the selecting process. As a result, the durability of the ink roller is improved and the printing cycle time can be shortened. In short, the present invention provides for a printing device which is small in size, light in weight, inexpensive and of great durability.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A printing device, comprising:

at least one character ring having printing characters on the periphery thereof;

a first rotatable shaft for supporting said character ring;

engaging means on said character ring for selectively operatively engaging said character ring with said first rotatable shaft for rotating a selected character on said ring from a stand-by position to a printing position and from said printing position to said stand-by position;

selection means for activating said engaging means into engagement with said first rotatable shaft and for deactivating said engaging means out of engagement with said first rotatable shaft and thereby initiating and terminating rotation of said character ring, respectively;

drive means including a second shaft having a magnetic disc mounted thereon, said drive means for rotating said magnetic disc for activating said selection means; and electro-magnet means including a fixed coil and a moveable iron core adjacent to said disc, said iron core being free to slide within said fixed coil for making frictional contact with said disc and means for selectively activating the fixed coil for sliding said iron core into frictional contact with said disc to be moved thereby, said iron core cooperating with a portion of said selection means for actuating the engaging means into engagement with said first rotatable shaft for rotating said character ring.

2. The printing device as defined in claim 1, wherein said selection means is moveable between a stand-by position and a second selection position during actuation when said engagement means engages said first rotatable shaft and includes integral biasing means for returning said selection means from said selection position to said stand-by position when said selection means is deactivated.

3. The printing device as defined in claim 1, wherein said first rotatable shaft includes grooves on the periphery thereof and wherein said engaging means includes a claw member affixed to said character ring, said claw member being arranged and constructed for engaging with the grooves on said first rotatable shaft and bringing said character ring into rotation with said shaft, said claw member being spring biased for engagement with said shaft.

4. The printing device as defined in claim 3, wherein said selection means is moveable between a stand-by position and a selection position, said selection means being arranged for holding said engaging means out of engagement with the grooves of said first rotatable shaft when in said stand-by position and in engagement with the grooves of said first rotatable shaft when in said selection position for initiating and terminating rotation of said character ring.

5. The printing device in claim 1, wherein the iron core is spaced apart from said disc for defining a gap therebetween, said iron core is disposed for moving in a direction such as to close said gap on activation of said electro-magnet means.

6. The printing device as defined in claim 1, wherein said iron core is moveable between a stand-by position and a selection position, said selection means being arranged for holding said engageing means out of engagement with said first rotatable shaft when said iron core is in said stand-by position and permitting said engagement means to activate and engage said first rotatable shaft when said iron core is in said selection position in response to the displacement of said iron core to the selection position.

7. The printing device as defined in claim 1, wherein said selection means is mounted on said second shaft with clearance, and said electro-magnet means is disposed for drawing said selection means into engagement with said iron core of said magnetic disc for rotation of said selection means about said second shaft on activation of said fixed coil of said electro-magnet means.

8. The printing device as defined in claim 1, wherein said selection means is of iron and mounted on said second rotatable shaft with clearance, said selection means being proximate said disc and spaced apart therefrom with a small gap therebetween, said electro-magnet means having an iron core so shaped and disposed that said core, said disc and said selection means constitute the magnetic circuit of said electro-magnet means and so that said gap is closed on activation of said fixed coil of said electro-magnet means, bringing said selection means into frictional engagement with said disc and causing rotation of said selection means and activation of said engagement means.

* * * * *